US006753049B2

(12) United States Patent
De Vries

(10) Patent No.: US 6,753,049 B2
(45) Date of Patent: Jun. 22, 2004

(54) ARTIFICIAL TURF INCLUDING DAMPING MATERIAL

(76) Inventor: Hugo De Vries, Ringdijk 430, NL-2983 GS Ridderkerk (NL)

( * ) Notice: Subject to any disclaimer, the term of this patent is extended or adjusted under 35 U.S.C. 154(b) by 0 days.

(21) Appl. No.: 10/148,523

(22) PCT Filed: Dec. 4, 2000

(86) PCT No.: PCT/NL00/00894

§ 371 (c)(1),
(2), (4) Date: Oct. 8, 2002

(87) PCT Pub. No.: WO01/48322

PCT Pub. Date: Jul. 5, 2001

(65) Prior Publication Data

US 2003/0108688 A1 Jun. 12, 2003

(30) Foreign Application Priority Data

Dec. 2, 1999 (NL) ..... 1013729

(51) Int. Cl.[7] ..... E01C 13/00

(52) U.S. Cl. ..... 428/17; 428/212; 428/217; 273/DIG. 13

(58) Field of Search ..... 428/17, 119, 212, 428/217; 273/DIG. 13

(56) References Cited

U.S. PATENT DOCUMENTS 3,900,656 A 8/1975 Schmidt

FOREIGN PATENT DOCUMENTS

| | | |
|---|---|---|
| DE | 626333 | 7/1934 |
| EP | 0 174 755 | 3/1986 |
| EP | 0 678 622 | 10/1995 |
| FR | 2 719 619 | 11/1995 |
| WO | WO 98/23817 | 6/1998 |

*Primary Examiner*—Alexander S. Thomas
(74) *Attorney, Agent, or Firm*—Webb Ziesenheim Logsdon Orkin & Hanson P.C.

(57) ABSTRACT

The invention relates to an artificial turf with a backing and a large number of artificial grass blades which are fixed thereto, protrude substantially transversely thereof and are manufactured from plastic, and a fibrous, inherently damping material arranged between the artificial grass blades and connected to the backing or the blades. The fibrous, inherently damping material can herein be arranged in the form of a large number of blades which are connected to the backing and which likewise extend transversely of the backing, but less far than the artificial grass blades. The fibrous, inherently damping material can also take the form of a knit through which the artificial grass blades protrude and which can be formed integrally with the backing.

13 Claims, 2 Drawing Sheets

ARTIFICIAL TURF INCLUDING DAMPING MATERIAL

BACKGROUND OF THE INVENTION

1. Field of the Invention

Figure 1:
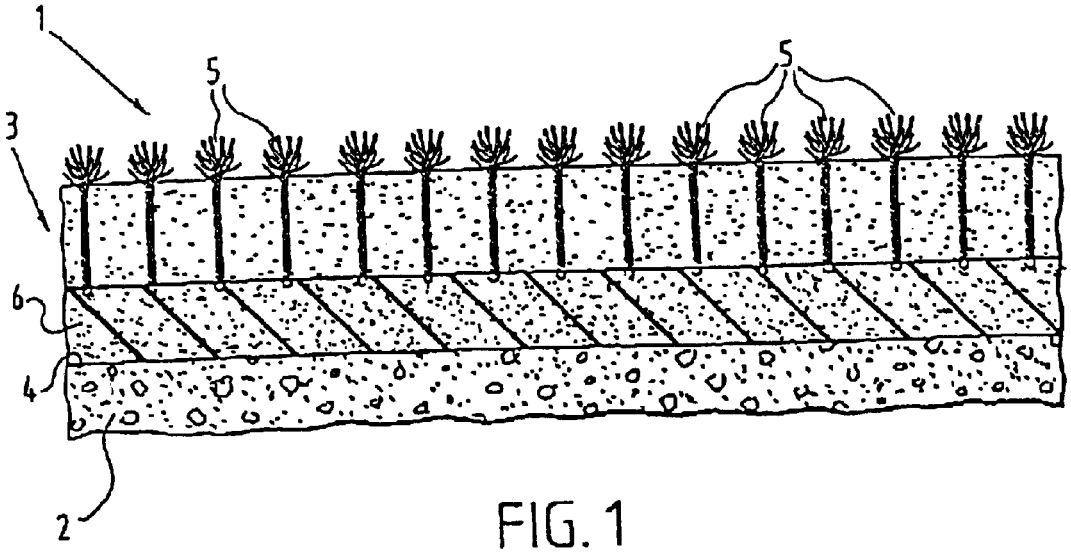

The present invention relates to an artificial turf, comprising a backing and a large number of artificial grass blades which are fixed thereto, protrude substantially transversely thereof and are manufactured from plastic. Such an artificial turf is generally known and is used on a large scale for practising sports such as football, hockey, tennis, rugby, baseball, American football and the like.

2. Description of the Prior Art

The known artificial turf consists of a backing, for instance a fabric of synthetic yarns to which a large number of artificial grass blades is fixed. These artificial grass blades, which can be tufted or knitted to the back or co-woven therewith, protrude substantially transversely of the backing. The is artificial grass blades are generally manufactured from somewhat hard and smooth types of plastic, for instance polyolefins such as polyethylene, polypropylene or mixtures thereof, or polyamides such as nylon. The artificial grass blades thus form a relatively robust and wear-resistant ground for playing sport or games.

In order to form an artificial grass surface the known artificial turf is arranged on a firm substrate or base layer of for instance sand, asphalt, stone chippings, lava or other preferably moisture-permeable material. Particular types of artificial turf herein also have sand spread therein after laying thereof.

In order to be able to play on the surface in the same manner as on a normal grass field, it is important that the artificial turf surface has roughly the same properties, particularly in respect of aspects such as the behaviour of the ball on the surface. For this purpose the artificial turf surface must be somewhat resilient and able to dampen shocks sufficiently, which is also important in preventing injuries to joints. This is the reason that the known artificial turf surface is generally provided with a damping material. This damping material, for instance rubber or a polyurethane foam, can be arranged under the artificial turf, whereby the damping action is however not very direct.

Use is therefore frequently made of rubber in the form of grains or granulate, which is arranged between the artificial grass blades. These rubber granules, which in the case of an artificial turf surface with sand spread therein can be mixed with the sand, as for instance described in the U.S. Pat. No. 5,958,527, here therefore lie loose in the artificial turf. This has the drawback that it is not simple to obtain and maintain a uniform distribution of the damping over the surface of the artificial turf, since the rubber granules are per se not wholly identical and, when the field is used, will moreover be displaced and thus be spread unevenly. In the case of rainfall on a field with poor vertical drainage the granules can for instance be washed away to lower-lying parts of the field. In addition, the granules can come to lie on the surface, whereby they may adhere to the ball and the playing surface will furthermore become relatively rough locally. Also when the rubber granules are used in a surface with sand spread therein, there occurs in practice rapid separation of the sand and the rubber granules, whereby the damping will vary considerably over the surface.

SUMMARY OF THE INVENTION

The invention now has for its object to provide an artificial turf wherein these drawbacks do not occur. According to the invention this is achieved in an artificial turf of the above described type by a fibrous, inherently damping material arranged between the artificial grass blades and connected to the backing or the blades. "Inherently damping" material is herein understood to mean a material which is relatively soft and resilient per se, irrespective of its embodiment, while "fibrous" is understood to mean any elongate, slender embodiment of the material. Connecting the damping material to the rest of the turf prevents it being displaced and a uniform distribution thereof is thus ensured, which can moreover be adjusted and monitored during production of the artificial turf. In addition, the fibrous nature of the damping material also results in a further improvement of the damping action.

The inherently damping material is preferably a material different from the plastic from which the artificial grass blades are manufactured. The somewhat conflicting requirements of resistance to wear on the one hand and good damping on the other can thus be satisfied by a suitable choice of material. The inherently damping material is advantageously less stiff herein than the plastic of the artificial grass blades, so that, even in the case of corresponding material thicknesses, there still exist differences in damping between the artificial grass blades and the inherently damping material.

An artificial turf which is simple to manufacture and to lay is obtained when the fibrous, inherently damping material is arranged in the form of a large number of blades connected to the backing. These blades then preferably extend substantially transversely of the backing.

In order to prevent the playing characteristics of the artificial turf being affected by the damping material, the blades of the damping material advantageously protrude less far from the backing than the artificial grass blades. To this end the blades of the damping material can be shorter than the artificial grass blades, but it is also possible for them to be frizzed.

In another embodiment of the artificial turf according co the invention the fibrous, inherently damping material takes the form of a knit through which the artificial grass blades protrude. This knit is then preferably formed integrally with the backing, whereby the structure of the artificial turf is simplified.

The damping material, which is preferably moisture-absorbing so as to prevent injuries such as burns in the case of a 'sliding tackle', can be a natural or synthetic rubber, although a flexible plastic such as for instance a polyurethane can also be envisaged. Said materials can herein be applied in solid form or as foam.

In a variant of the artificial turf according to the invention of particularly simple structure, the inherently damping material is formed by the same plastic as that from which the artificial grass blades are manufactured.

BRIEF DESCRIPTION OF THE DRAWNGS

Figure 2:
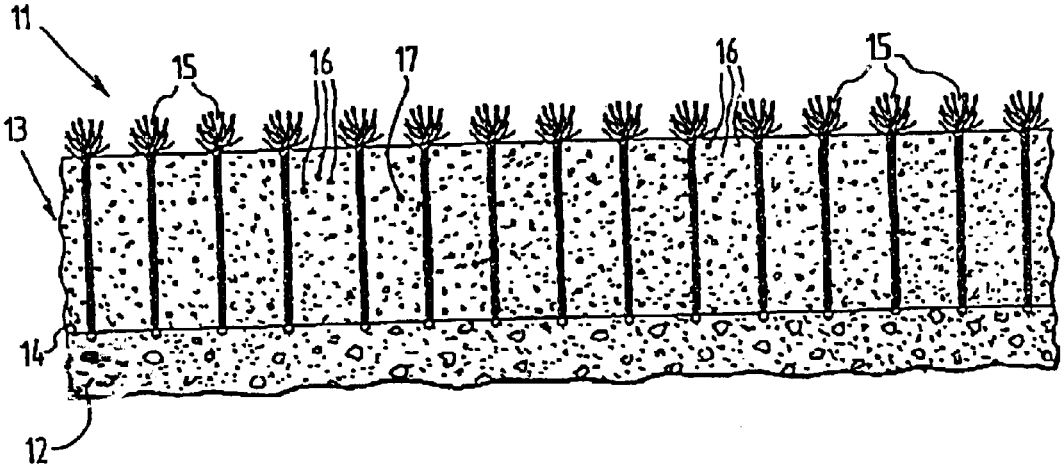
Figure 3:
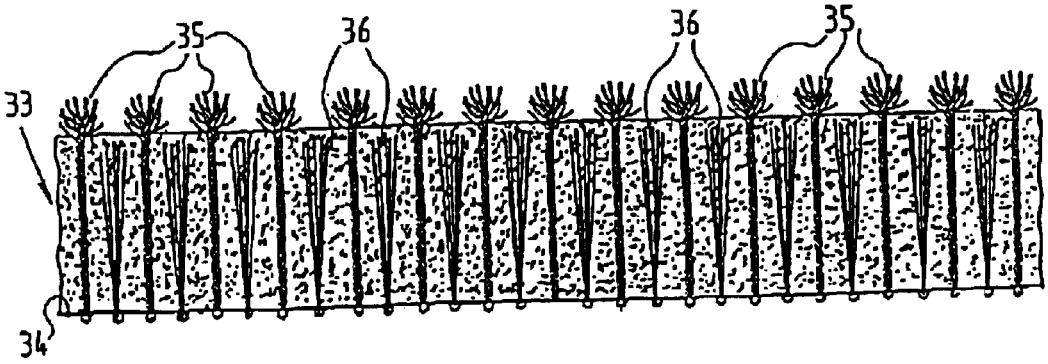
Figure 4:
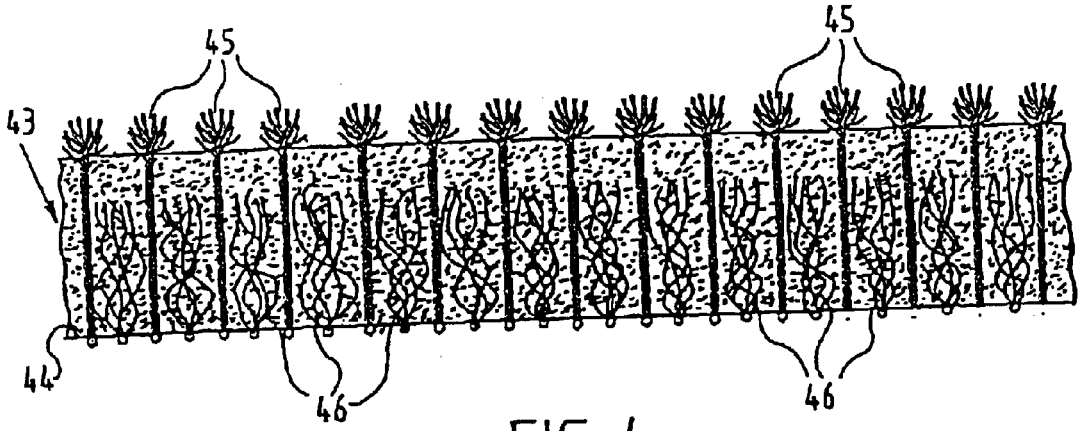
Figure 5:
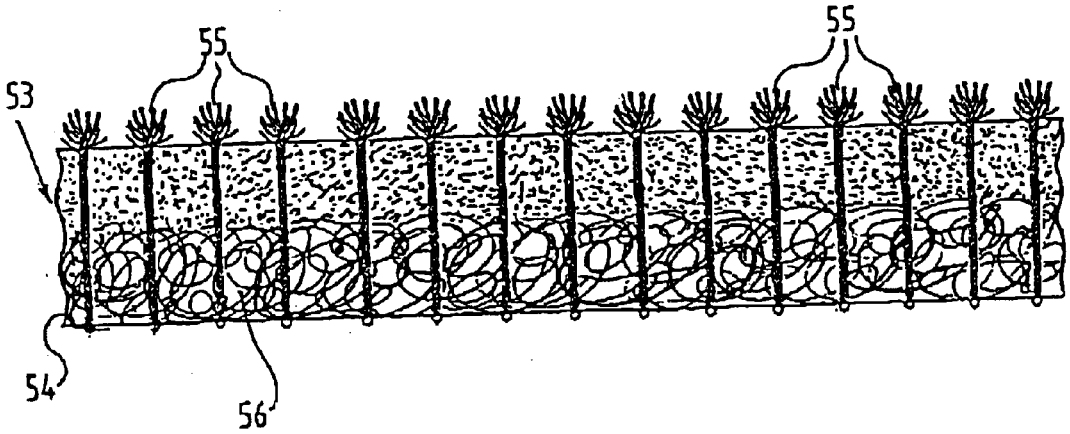

The invention is now elucidated on the basis of three embodiments, wherein reference is made to the annexed drawing, in which:

FIG. 1 is a cross-sectional view showing schematically the structure of a prior art artificial turf surface, FIG. 2 is a view corresponding to FIG. 1 of another prior art artificial turf surface, FIG. 3 is a cross-sectional view of an artificial turf according to a first embodiment of the invention, FIG. 4 shows a second embodiment of the artificial turf according to the invention, and FIG. 5 is a view corresponding with FIGS. 3 and 4 of a third embodiment of the artificial turf.

DETAILED DESCRIPTION OF THE PREFERRED EMBODIMENTS

A prior art artificial turf surface 1 is formed by a preferably moisture-permeable base layer 2 of for instance sand, asphalt, broken stone chippings or lava granules, on which is arranged an artificial turf 3 (FIG. 1). The artificial turf 3 herein consists of a backing 4 having fixed thereto a large number of standing blades 5 of a relatively hard and smooth plastic material, such as for instance polyolefins such as polyethylene, polypropylene or mixtures thereof, or polyamides such as nylon. In order to give the artificial turf surface 1 a somewhat resilient nature corresponding with a natural grass field, a resilient layer 6 of a damping material is arranged between base layer 2 and artificial turf 3, such as for instance optionally bonded granules or mats of a natural or synthetic rubber or a foam plastic. In the case of this artificial turf surface 1 the whole artificial turf 3 is thus resiliently supported, whereby an indirect damping and a relatively hard and rigid surface is obtained.

In another variant of a prior art artificial turf surface 11 the damping material 16 is not arranged between base layer 12 and artificial turf 13, but in the artificial turf 13 between artificial grass blades 15 (FIG. 2). The damping material 16 is herein formed by rubber granules which in the shown embodiment are mixed into a layer 17 of spread sand. Rubber granules 16 and sand 17 are found in practice to separate when the artificial turf surface 11 is played on, whereafter rubber granules 16 come to lie free and are displaced through or over the artificial turf 13, which results in uneven damping of artificial turf surface 11. The properties of the turf are moreover adversely affected by rubber granules 16 possibly lying on the surface of artificial turf 13, while rubber granules 16 may even affect the game by adhering to for instance a playing ball.

According to the invention an artificial turf 33 is now proposed which likewise consists of a backing 34 and a large number of synthetic blades 35 fixed thereto, but wherein the damping material 36 is connected on the upper side to the rest of the turf 3. According to a first preferred embodiment of the invention the damping material 36 is herein formed by blades or fibres of for instance natural or synthetic rubber or a plastic which is more flexible than the plastic from which the artificial grass blades 35 are manufactured (FIG. 3). These damping blades or fibres 36 are connected to the backing 34 of artificial turf 33, for instance by tufting, knitting or weaving. In principle the damping blades 36 can be attached to backing 34 in the same manner and in the same processing operation as the artificial grass fibres 35.

It may further be of importance in particular conditions for the damping blades 36 to protrude less far outside backing 34 than the actual artificial grass blades 35, in order to prevent them from forming the playing surface. This is because the properties of the damping fibres 36, in particular the roughness thereof, could negatively affect the playability of the artificial turf surface. In the shown embodiment this is achieved by giving damping fibres 36 a shorter length than artificial grass fibres 35.

In an alternative embodiment of artificial turf 43 the damping blades 46 are not straight but frizzed (FIG. 4). Thus is achieved that while they have the same length as artificial grass blades 45 they do not protrude thereabove, while a relatively large volume of damping material is nevertheless incorporated into artificial turf 43.

Yet another embodiment of the artificial turf 53 has a layer of damping material 56 in the form of a knit is of damping fibres (FIG. 5). Backing 54 can herein be formed by a non-woven fixed to one side of the knit, but it is also possible to wholly dispense with a separate backing and to fix the artificial grass blades 56 directly to the knit of damping fibres 56, by tufting or knitting. Such an artificial turf 53 is very simple to manufacture.

When a moisture-absorbing material is chosen as damping material, i.e. a material which can not only absorb moisture but also relinquish it, such as for instance a foam, an artificial turf is obtained on which 'sliding tackles' can be made without this resulting in burns, as is the case with conventional artificial turfs. The moisture taken up in the material is then released again when the material is loaded, for instance compressed, and thus forms a thin sliding layer.

The invention thus provides an artificial turf displaying a very good damping which is comparable to the damping of natural grass and wherein this damping is uniform over the whole surface. In addition, the artificial turf according to the shown preferred embodiments of the invention is relatively simple to manufacture on existing machines and with existing methods, because the damping fibres or blades can be incorporated therein in the same manner as the actual artificial grass fibres.

Although the invention is elucidated above with reference to a number of embodiments, it will be apparent to the skilled person that it is not limited thereto. The damping blades do not for instance have to be manufactured entirely from a damping material, but could also be formed by fibres of a harder type of plastic, for instance the same plastic as the actual artificial grass fibres, which could then be coated with a flexible damping layer. The artificial grass blades could also be manufactured from the same plastic as the damping fibres, whereby an artificial turf would be obtained which is simple to manufacture. Furthermore, the invention is not limited to wholly artificial turf surfaces, but could also be applied in so-called hybrid turfs, as described for instance in the earlier patent WO 98/23817 of applicant.

The scope of the invention is therefore defined solely by the appended claims.

What is claimed is:

1. An artificial turf comprising a backing, a large number of artificial grass blades which are fixed thereto, protrude substantially transversely thereof and are manufactured from plastic, and a fibrous material arranged between the artificial grass blades and connected to the backing or the blades, said fibrous material differing from the plastic from which the artificial grass blades are manufactured, wherein the fibrous material is less stiff than the plastic from which the artificial grass blades are manufactured so as to have inherent damping characteristics.

2. The artificial turf as claimed in claim 1, wherein the fibrous material is arranged in the form of a large number of blades connected to the backing.

3. The artificial turf as claimed in claim 2, wherein the blades of the fibrous material extend substantially transversely of the backing.

4. The artificial turf as claimed in claim 3, wherein the blades of the fibrous material protrude less far from the backing than the artificial grass blades.

5. The artificial turf as claimed in claim 4, wherein the blades of the fibrous material are shorter than the artificial grass blades.

6. The artificial turf as claimed in claim 5, wherein the blades of the fibrous material are frizzed.

7. The artificial turf as claimed in claim 4, wherein the blades of the fibrous material are frizzed.

8. The artificial turf as claimed in claim 1, wherein the fibrous material takes the form of a knit through which the artificial grass blades protrude.

9. The artificial turf as claimed in claim 8, wherein the knit is formed integrally with the backing.

10. The artificial turf as claimed in claim 1, wherein the fibrous material is moisture absorbing.

11. The artificial turf as claimed in claim 1, wherein the fibrous material is a rubber.

12. The artificial turf as claimed in claim 11, wherein the fibrous material is a foam.

13. The artificial turf as claimed in claim 1, wherein the fibrous material is a plastic.

* * * * *